US011235258B2

(12) United States Patent
Brister

(10) Patent No.: US 11,235,258 B2
(45) Date of Patent: Feb. 1, 2022

(54) VANISHING ILLUSION SYSTEM

(71) Applicant: Universal City Studios LLC, Universal City, CA (US)

(72) Inventor: Michael Keith Brister, Winter Garden, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 17/166,784

(22) Filed: Feb. 3, 2021

(65) Prior Publication Data

US 2021/0291071 A1 Sep. 23, 2021

Related U.S. Application Data

(60) Provisional application No. 62/991,953, filed on Mar. 19, 2020.

(51) Int. Cl.

| | |
|---|---|
| ***A63J 5/00*** | (2006.01) |
| ***A63G 31/02*** | (2006.01) |
| ***A63J 21/00*** | (2006.01) |

(52) U.S. Cl.

CPC ..... *A63J 21/00* (2013.01); *A63G 31/02* (2013.01)

(58) Field of Classification Search

CPC ..... A63J 5/00; G02B 30/60; A63G 21/00; A63G 31/02

USPC ..... 472/43, 58, 63, 71, 81

See application file for complete search history.

(56) References Cited

U.S. PATENT DOCUMENTS

| | | | | |
|---|---|---|---|---|
| 1,699,345 | A | 1/1929 | Chandlee | |
| 5,685,625 | A | 11/1997 | Beaver | |
| 5,890,787 | A | 4/1999 | McNelley et al. | |
| 7,420,732 | B2 | 9/2008 | Huber | |
| 7,883,212 | B2 * | 2/2011 | O'Connell ..... | A63J 25/00 353/10 |
| 9,173,509 | B2 | 11/2015 | Mischel, Jr. et al. | |
| 2008/0146356 | A1 | 6/2008 | Gaughan | |
| 2019/0270029 | A1 | 9/2019 | Matson | |

OTHER PUBLICATIONS

PCT/US2021/021477 International Search Report and Written Opinion dated Jun. 16, 2021.

* cited by examiner

*Primary Examiner* — Kien T Nguyen
(74) *Attorney, Agent, or Firm* — Fletcher Yoder, P.C.

(57) ABSTRACT

Systems and method for generating a vanishing illusion special effect are provided. One approach involves two rooms that mirror each other and are separated by a wall. The wall includes a frame through which the transition glass is configured to move. The transition glass includes a mirrored portion and a transparent portion. A controller may instruct an actuator to move the transition glass such that the mirrored portion is in alignment or out of alignment relative to the frame. In a further embodiment, a first ride vehicle and a second ride vehicle mirror each other and are separated by a transition glass that also includes a mirrored portion and a transparent portion. A controller may regulate the movement of the first ride vehicle and the second ride vehicle from a position in alignment to a position out of alignment relative to the mirrored portion or the transparent portion.

20 Claims, 7 Drawing Sheets

VANISHING ILLUSION SYSTEM

CROSS REFERENCE TO RELATED APPLICATIONS

This application claims priority from and the benefit of U.S. Provisional Application Ser. No. 62/991,953, entitled "VANISHING ILLUSION SYSTEM," filed Mar. 19, 2020, which is hereby incorporated by reference in its entirety for all purposes.

BACKGROUND

The present disclosure relates generally to systems and methods for generating a vanishing illusion effect. More specifically, the present disclosure is related to generating the vanishing illusion by using a transition glass.

This section is intended to introduce the reader to various aspects of art that may be related to various aspects of the present disclosure. This discussion is believed to be helpful in providing the reader with background information to facilitate a better understanding of the various aspects of the present disclosure. Accordingly, it should be understood that these statements are to be read in this light and not as admissions of prior art.

An amusement or theme park generally includes a variety of entertainment systems or attractions that each provides a unique experience for guests of the amusement park. For example, the amusement park may include different attraction systems, such as a roller coaster, a drop tower, a log flume, and so forth. Some attraction systems may include an environment that may have several different features, such as animated figures and special effects, which help immerse guests in the experience of the attraction system. However, installation and configuration of the features may be difficult and/or the features may not satisfactorily provide the desired effect or experience for the guests. Therefore, improved features and techniques are useful to provide a desirable effect or experience for the guests.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a system for generating a vanishing illusion may be provided. In accordance with this embodiment, the system includes a first room and a second room, and the second room mirrors the first room. The first room may be separated from the second room via a wall. The wall includes a frame coupled to a transition glass, and the transition glass includes a mirrored portion and a transparent portion. In some implementations, an actuator may enable the transition glass to move such that the mirrored portion is in alignment relative to the frame. In other implementations, the actuator may enable the transition glass to move such that the mirrored portion is out of alignment relative to the frame.

In an embodiment, a method for generating a vanishing illusion may be provided. In accordance with this method, a processor receives an indication of a viewer disposed in a first room based on data acquired from one or more sensors. The first room mirrors a second room. The processor identifies motion in the first room via one or more sensors. The first room is separated from the second room via a wall, and the wall includes a frame coupled to a transition glass. The transition glass includes a mirrored portion and a transparent portion. In response to identifying motion in the first room, the processor actuates the transition glass to move such that the mirrored portion is in alignment or out of alignment relative to the frame.

In an embodiment, a theme park attraction system for generating a vanishing illusion is provided. In accordance with this embodiment, the system includes a first ride vehicle and a second ride vehicle. The second ride vehicle mirrors the first ride vehicle. A transition glass separates the first ride vehicle from the second ride vehicle, and the transition glass includes a mirrored portion, a fading portion, and a transparent portion. Respective motors of the first and second ride vehicles may enable both vehicles to move from a first position in alignment relative to the mirrored portion, the fading portion, or the transparent portion to a second position out of alignment relative to the mirrored portion, the fading portion, or the transparent portion.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
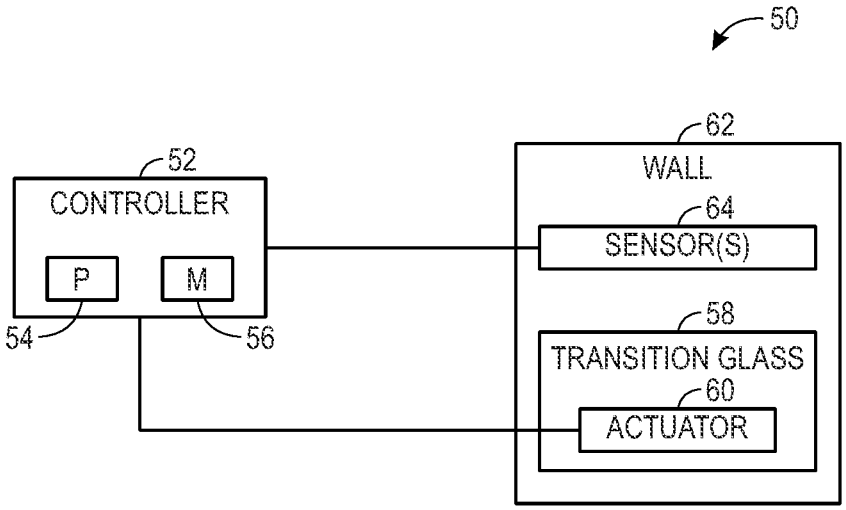
FIG. 1 is a block diagram of an illusion system that generates a vanishing special effect via a transition glass, in accordance with an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. One or more specific embodiments of the present embodiments described herein will be described below. In an effort to provide a concise description of these embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

An amusement park may include an illusion system that generates a vanishing special effect to provide a guest experience at an amusement park attraction. Indeed, combinations of certain hardware configurations (e.g., circuitry), software configurations (e.g., algorithmic structures and/or modeled responses), as well as certain attraction features may be utilized to provide guests with a vanishing special effect.

The vanishing special effect may entail the guest appearing to disappear or turn invisible. Such an illusion may be achieved without altering lighting systems or using 3D glasses, additional media, and so forth. An illusion system may generate the vanishing special effect via movement of a transition glass. In some embodiments, an amusement park attraction or ride may include two rooms (e.g., a first room and a second room) that at least partially mirror each other and are divided by a wall. For example, the second room may completely mirror (e.g., be a true or accurate reflection) of the first room. "Completely mirror" or "true reflection", as used herein, may refer to when each object in the first room corresponds to or aligns with each object in the second room. In alternative embodiments, the second room may partially mirror (e.g., be a partial reflection of) the first room. "Partially mirror" or "partial reflection" may refer to when most objects in the first room correspond to or align with most objects in the second room, while there may be one or more objects in the second room that do not perfectly correspond to or align with any objects in the first room (or vice versa). One or more guests may have access to enter the first room but may not have access to the second room. In fact, the one or more guests may be unaware of the presence of the second room. Further, the wall, which separates the two rooms, may include a frame that the transition glass may move with respect to. The transition glass may be actuatable within the frame and may include a mirrored portion, a fading portion, and a transparent portion. In response to receiving data associated with one or more of motion, light, or sound, a controller may instruct an actuator to move the transition glass with respect to the frame. Based on the data acquired by one or more sensors, the controller may identify the presence of one or more guests in the first room. The one or more guests may be sitting, standing, or generally located in the first room. Detecting motion data (e.g., correlating with a predefined motion signature) associated with the one or more guests (e.g., waving of a wand) may prompt the controller to instruct the actuator to move the transition glass with respect to the frame.

By way of example, when the one or more guests enter the first room, the mirrored portion of the transition glass may be in alignment relative to the frame. As a result, the one or more guests may see a mirrored image of the first room, or in other words, a reflection of themselves and the first room. When the controller receives motion data (e.g., a motion signature) or other triggering inputs from the one or more sensors, the controller may instruct the actuator to move the transition glass such that the fading portion of the transition glass is in alignment relative to the frame. As a result, the one or more guests may see a combination of a portion of the mirrored image of the first room and a portion of the second room via the transition glass. The fading portion may be made of a combination of thin strips of mirror and thick strips of glass. The strips may be triangular, rectangular, or any other suitable shape. The fading portion serves as a transition from a reflection of the one or more guests in the first room to a vanishing appearance of the one or more guests in the first room. The controller may instruct the actuator to continue moving the transition glass such that the transparent portion of the transition glass is in alignment relative to the frame, making it appear as if the one or more guests have vanished. That is, because the second room behind the wall mirrors the first room, it may be appear that the first room is empty, and the one or more guests have vanished. In reality, the one or more guests are viewing the second room, which mirrors the first room, via the transparent portion of the transition glass. In sum, movement of the transition glass may create an illusion of the one or more guests vanishing.

In another embodiment, the vanishing special effect may be achieved via movement of one or more ride vehicles. For example, an amusement park attraction or ride may include two ride vehicles that mirror each other. The ride vehicles and their respective tracks may be separated via a transition glass. In one embodiment, the transition glass may be stationary, and the one or more guests may be seated in a first ride vehicle but may be unaware of the presence of the second ride vehicle. The transition glass may include a mirrored portion, a fading portion, and a transparent portion. When the first ride vehicle, in which the one or more guests are seated, is in alignment with the mirrored portion, the guest may see a mirrored image of the first ride vehicle. As the first ride vehicle moves along its respective track, the second ride vehicle behind the wall moves together with the first ride vehicle. When both ride vehicles are in alignment with the fading portion, the one or more guests may see a combination of the mirrored image of the first ride vehicle and the second ride vehicle.

As mentioned above, the fading portion may be made of a combination of thin strips of mirror and thick strips glass. The strips may be triangular, rectangular, or any other suitable shape. The fading portion serves as a fading or gradual transition from a reflection of the one or more guests in the first ride vehicle to a vanishing appearance of the one or more guests in the first ride vehicle. When both ride vehicles are in alignment relative to the transparent portion, the one or more guests may appear to have vanished. That is, the second ride vehicle behind the transition glass mirrors the first ride vehicle so that it may appear as if the first ride vehicle is empty when the one or more guests view the second ride vehicle through the transparent portion of the transition glass. In this process, the one or more guests in the first ride vehicle may appear to have disappeared. In sum, movement of both ride vehicles with respect to the transition glass may create an illusion of the one or more guests vanishing.

Turning to the figures, FIG. 1 illustrates a block diagram of an illusion system 50 that generates a vanishing special effect via an actuatable transition glass 58, in accordance with an embodiment of the present disclosure. As shown, the system 50 may include the transition glass 58, a controller 52, and one or more sensors 64. In some embodiments, the one or more sensors 64 may be disposed in a wall 62, a first room, or both. The wall 62 may serve as a physical divider between the first room and a second room that mirrors the first room. As mentioned above, one or more guests may have access to enter the first room but not the second room. In some embodiments, the one or more guests, who may be disposed in the first room, may be unaware of the presence of the second room behind the wall 62. The wall 62 may include a frame attached to the transition glass 58. The transition glass 58 may be actuatable (e.g., movable via one or more actuators 60) and may include a mirrored portion, a fading portion, and a transparent portion. In an embodiment, each portion of the transition glass 58 (the mirrored portion, the fading portion, and/or the transparent portion) may have similar dimensions (e.g., length and width) as the frame. That is, each of the mirrored portion, the fading portion, and/or the transparent portion may fill the frame without another of the portions being in the frame. The transition glass 58 may move relative to the frame. Movement of the transition glass 58 may be controlled by an actuator 60 attached to the transition glass 58. The actuator 60 may be any suitable type and number of actuators for providing motion, including, but not limited to, an electrical actuator, a hydraulic actuator, a pneumatic actuator, a mechanical actuator, a linear actuator, a rotary actuator, or any combination thereof. Based on instructions from the controller 52, the actuator 60 may regulate the movement of the transition glass 58. In some embodiments, the actuator 60 represents a set of multiple actuators that connect to the transition glass 58 and provide motion of the transition glass 58. Such motion of the transition glass 58 may include linear movements, such as heave and surge.

In certain embodiments, the actuator 60 and the one or more sensors 64 are communicatively coupled to the controller 52. The controller 52 may execute hardware and/or software control algorithms to regulate movement of the transition glass 58. The controller 52 may include a programmable logic controller (PLC) or other suitable control device. According to some embodiments, the controller 52 may include an analog to digital (A/D) converter, one or more microprocessors or general or special purpose computers, a non-volatile memory, memory circuits, and/or an interface board. For example, the controller 52 may include memory circuitry for storing programs, control routines, and/or algorithms implemented for control of the various system components, such as speed of moving the transition glass 58. The controller 52 also includes, or is associated with, input/output circuitry for receiving sensed signals from the one or more sensors 64, and interface circuitry for outputting control signals. Memory circuitry may store set points, actual values, historic values, and so forth, for any or all such parameters. Any other suitable devices may be included in the illusion system 50, such as additional transducers or switches that sense motion, light, sound, and so forth in the first room. Further, other values and/or set points may be used to determine when and how to operate the movement of the transition glass 58. For example, the controller 52 may determine the distance the transition glass 58 may move, the direction (e.g., left, right) in which the transition glass 58 may move, and/or the frequency (e.g., regular or irregular time intervals) at which the transition glass 58 may move. The controller 52 also may include components for operator interaction with the systems, such as display panels and/or input/output devices for checking operating parameters, inputting control signals representative of set points and desired operating parameters, checking error logs and historical operations, and so forth. The controller 52 may receive data from the one or more sensors 64 and/or control the actuator 60, which in turn controls the movement of the transition glass 58.

The controller 52 may include a processor(s) 54 (e.g., a microprocessor(s)) that may execute software programs to control the illusion system 50. Moreover, the processor 54 may include multiple microprocessors, one or more "general-purpose" microprocessors, one or more system-on-chip (SoC) devices, one or more special-purpose microprocessors, one or more application specific integrated circuits (ASICs), and/or one or more reduced instruction set computer (RISC) processors. The controller 52 may include a memory device 56 that may store executable instructions and/or information such as control software, look up tables, configuration data, etc.

The memory device 56 may include a tangible, non-transitory, machine-readable medium, such as a volatile memory (e.g., a random access memory (RAM)) and/or a nonvolatile memory (e.g., a read-only memory (ROM), flash memory, a hard drive, and/or any other suitable optical, magnetic, or solid-state storage medium). The memory device 56 may store a variety of information that may be used for various purposes. For example, the memory device 56 may store machine-readable and/or processor-executable instructions (e.g., firmware or software) for the processor 54 to execute. In particular, the memory device 56 may store instructions that cause the processor 54 to regulate movement of the transition glass 58.

In certain embodiments, the one or more sensors 64 may include any of various sensor types useful in detecting the presence of one or more guests, location of the one or more guests, and/or motion data indicative of the performance of certain motions (e.g., correlating with predefined motion signatures) to the controller 52. As such, the one or more sensors 64 may detect changes in motion, light, sound, and so forth in the first room. For example, the one or more sensors 64 may include any number of location sensors, motion sensors, proximity sensors, ultrasonic sensors, photoelectric sensors, micro-electromechanical system (MEMS) sensors, sound sensors, and/or cameras. Additionally, the one or more sensors 64 may include pressure sensors, such as piezoelectric pressure sensors, differential pressure sensors, optical pressure sensors, and so on, included on the wall 62 and/or the first room.

Figure 2:
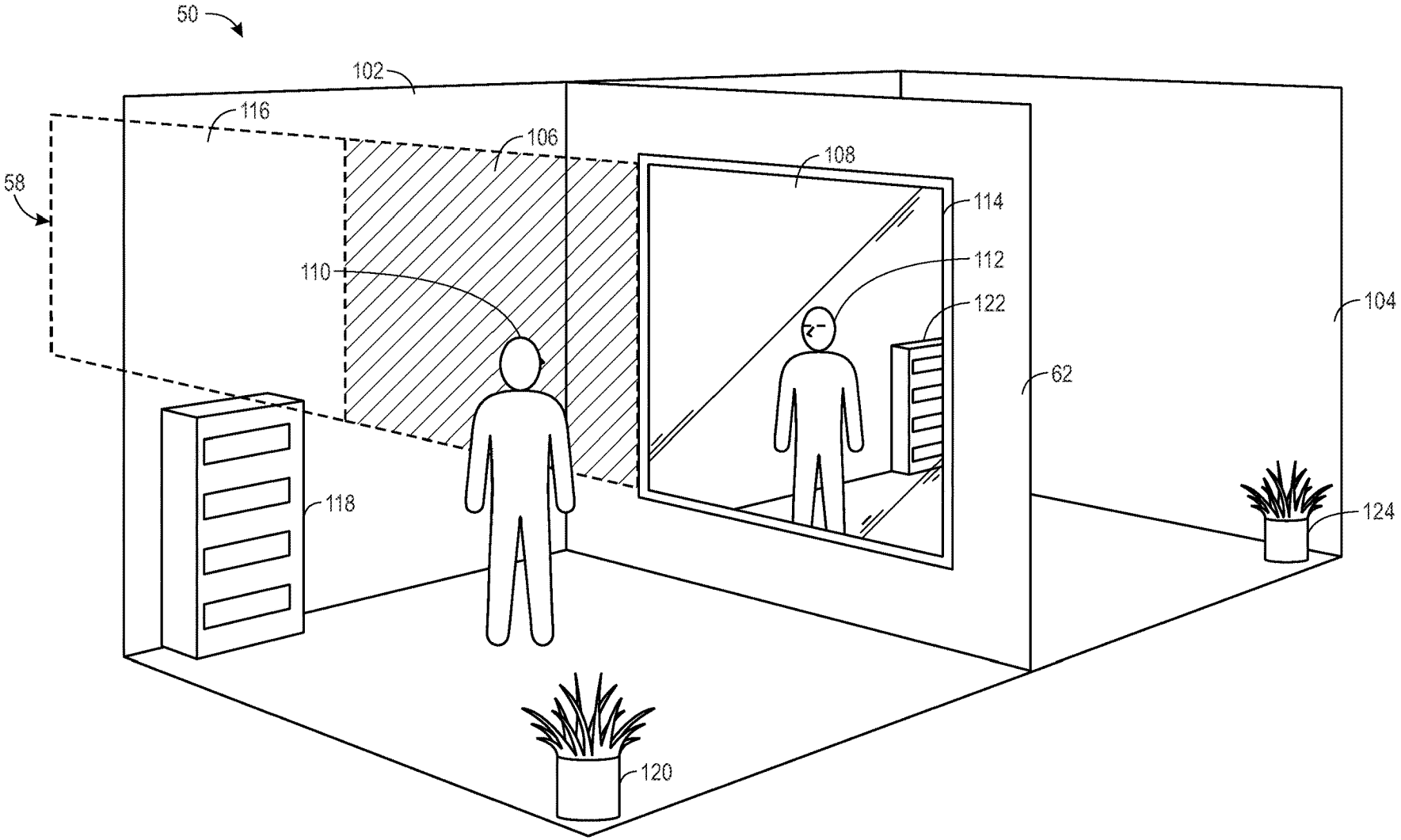
FIG. 2 is a schematic diagram of the illusion system of FIG. 1 generating the vanishing special effect with a mirrored portion of the transition glass, in accordance with an embodiment of the present disclosure.

Based on the data acquired from the one or more sensors 64, the controller 52 determines when and/or how to move the transition glass 58. Movement of the transition glass 58 may cause the vanishing special effect, in which the one or more guests appear to disappear or turn invisible. With the preceding in mind, FIG. 2 illustrates a schematic diagram of the illusion system 50 of FIG. 1, generating the vanishing special effect with a mirrored portion 108 of the transition glass 58, in accordance with an embodiment of the present disclosure. The system 50 may include a first room 102 and a second room 104. As viewed from the perspective of the first room, the second room 104 completely mirrors (e.g., is a mirror image duplicate) of the first room 102 including the actual or perceived dimensions, layout, and so forth, of the first room 102. For instance, each object in the first room 102 aligns with a corresponding object in the second room 104. In some embodiments, an object in the first room 102 may be aligned along a line normal to the transition glass or angled in the same direction as that of a corresponding object in the second room 104. The object in the first room 102 may be spaced the same distance away from the transition glass 58 as a corresponding object in the second room 104 is spaced away from the transition glass 58. For example, a plant 120 may be disposed in the first room 102. The plant 120 corresponds to a plant 124 disposed in the second room 104. The plant 120 and its corresponding plant 124 correlate in size, shape, color, alignment with respect to the transition glass 58, distance away from the transition glass 58, and so forth. Similarly, a bookshelf 118 may be disposed in the first room 102. A bookshelf 122 disposed in the second room 104 may correspond to the bookshelf 118, such that both the bookshelves 118 and 122 correlate in terms of size, shape, color, alignment with respect to the transition glass 58, distance away from the transition glass 58, and so forth.

In additional or alternative embodiments, the second room 104 may partially mirror (e.g., be a partial mirror image duplicate of) the first room 102, such that the second room 104 may include objects that do not correspond or align with any object in the first room 102, or vice versa. For example, the second room 104 may include additional or altered objects relative to the first room (e.g., footprints in or on a floor covering) that may not correspond to the objects as they appear in the first room 102. Alternatively, the second room 104 may include additional objects that do not align or correspond with any object in the first room 102 and that may leverage the apparent disappearance of the guest 110. For instance, unlike the first room 102, the second room 104 may include footprints in a corresponding area on which the "vanished" guest is presumably standing. Thus, from the perspective of the guest 110, when the transparent portion 116 is in alignment relative to the frame 114, it may appear as if his or her body has vanished but his or her footprints are left behind in the first room 102. In reality, the transparent portion 116 of the transition glass 58 enables the guest 110 to see footprints disposed in the second room 104.

A guest 110 may have access to enter the first room 102, but the guest 110 may not have access to enter the second room 104. In some embodiments, the guest 110 may represent multiple guests, who may be disposed in the first room 102. The wall 62 may include a frame 114 that moves with respect to the transition glass 58. The transition glass 58 may be actuatable and may include a mirrored portion 108, a fading portion 106, and a transparent portion 116. In an embodiment, each portion of the transition glass 58 (the mirrored portion 108, the fading portion 106, and the transparent portion 116) may have similar dimensions (e.g., length and width) as the frame 114. The transition glass 58 may move left or right along the wall 62 and relative to the frame 114 via the actuator 60.

When the guest 110 enters the first room 102, the mirrored portion 108 may be in alignment relative to the frame 114. In other words, the mirrored portion 108 may fill the frame 114 while the fading portion 106 and the transparent portion 116 may not be in the frame 114. Because the first room 102 may be separated from the second room 104 via the wall 62, the guest 110 may be unaware of the presence of the second room 104 when the mirrored portion 108 fills the frame 114. The mirrored portion 108 may include a rectangular mirror, a collection of mirrored strips of suitable size and shape, and so forth. When the mirrored portion 108 is in alignment relative to the frame 114, the guest 110 may see a mirrored image of the first room 102. In other words, the guest 110 may see a reflection 112 of him or herself and a reflection of the first room 102.

After the guest 110 has entered the first room 102 (FIG. 1), the controller 52 may receive data indicative of the presence of the guest 110 from the one or more sensors 64 (FIG. 1). Non-limiting examples of the data that may be indicative of the presence of the guest 110 and/or may prompt the controller 52 to move the transition glass 58, may include motion data, image data, sound data, pressure data, and/or displacement data. In some instances, the one or more sensors 64 include a camera, which acquires image data of the first room 102. The one or more sensors 64 may include a motion sensor that captures movement associated with the guest 110 in the first room. Furthermore, the one or more sensors 64 may include a proximity sensor or an ultrasonic sensor that may measure the distance of the guest 110 relative to the transition glass 58. The one or more sensors may include a sound sensor that captures noise associated with the guest 110. The one or more sensors may also include a piezoelectric sensor that captures pressure associated with the guest 110. In some embodiments, receiving data indicative of the presence of the guest 110 may be an optional step and may not be performed. For example, the vanishing effect may be performed at fixed time intervals based on a known rate. In another example, the vanishing effect may be performed based on the known or presumed rate of passage of the guests through an attraction.

Various factors may trigger the controller 52 to instruct the actuator 60 to move the transition glass 58. For instance, movement or motion data (e.g., a motion signature, such as the guest 110 waving a wand), sound data (e.g., the guest 110 reciting a phrase), pressure data (e.g., the guest 110 touching the mirrored portion 108), and/or displacement data (e.g., the guest 110 being less than a threshold distance, such as 5 inches or any other suitable threshold distance, from the transition glass 58) may prompt the controller 52 to activate movement of the transition glass 58. In additional or alternative embodiments, analyzing image data (e.g., the guest 110 facing the mirrored portion 108) may cause the controller 52 to initiate movement of the transition glass 58. Additionally, the rate and time intervals at which the transition glass 58 moves may be regular or irregular (e.g., varied or otherwise not constant).

Based on the data received from the one or more sensors 64, the controller 52 may instruct the actuator 60 to move the mirrored portion 108 out of alignment relative to the frame 114 and the transparent portion 116 into alignment relative to the frame 114. In some embodiments, during the process of moving the mirrored portion 108 out of alignment relative to the frame 114, the fading portion 106 may at least partially fill the frame 114 during the transition to displaying the transparent portion 116. That is, the fading portion 106 may partially or completely fill the space of the frame 114. The fading portion 106 may include a combination of mirrored parts and transparent parts. The transparent part may be made of glass, plexiglass, acrylic, plastic, or any other material that enables the guest to see the second room though it.

In some embodiments, the fading portion 106 may have a gradient that includes more mirrored parts and less transparent parts closer to the mirrored portion 108, and less mirrored parts and more transparent parts closer to the transparent portion 116. That is, a region of the fading portion 106 may have a greater reflectivity closer to the mirror portion 108 compared to a region of the fading portion 106 that is farther away from the mirrored portion 108. Thus, the fading portion 106 may provide a gradual increase in reflectivity toward the mirrored portion 108, while providing a gradual decrease in transparency. On the other hand, a region of the fading portion 106 that is closer to transparent portion 116 may have a greater transparency than a region of the fading portion 106 that is farther away from the transparent portion 116. Thus, the fading portion 106 may provide a gradual increase in transparency toward the transparent portion 116, but a gradual decrease in reflectivity.

In certain embodiments, the fading portion 106 may include alternating strips of mirror with strips of glass. The strips may be triangular, rectangular, or any other suitable shape. In alternative or additional embodiments, the fading portion 106 may include other suitable forms or materials (e.g., frosted glass) to cause an effect indicating that the vanishing effect is occurring. As a result, the guest 110 may see a combination of a portion of the mirrored image of the first room 102 and a portion of the second room 104 via the transition glass 58. The fading portion 106 serves as a fading or gradual transition from a reflection of the guest 110 in the first room 102 to a vanishing appearance of the guest 110 in the first room 102. Because the guest 110 may be unaware of the presence of the second room 104 and the mobility of the transition glass 58, the vanishing special effect or illusion may be particularly effective. From the perspective of the guest 110, when the fading portion 106 is in alignment relative to the frame 114, it may appear as if he or she is disappearing from the first room 102. In reality, through the transparent part of the fading portion 106, the guest 110 may see a portion of the second room 104, which may be a mirror of the first room 102, but without the presence of the guest 110. Further, through the mirrored part of the fading portion 106, the guest 110 may see a portion of his or her reflection in the first room 102.

In alternative embodiments, the transition glass 58 may not include the fading portion 106. As a result, when the controller 52 instructs the actuator 60 to move the mirrored portion 108 out of alignment relative to the frame and move the transparent portion 116 into alignment relative to the frame 114, the transparent potion 116 directly comes into alignment with the frame 114. Thus, the fading or gradual transition between the mirrored portion 108 and the transparent portion 116 may not exist. Further, the fading or gradual transition from a reflection of the guest 110 in the first room 102 to a vanishing appearance of the guest 110 in the first room 102 may not be present.

Figure 3:
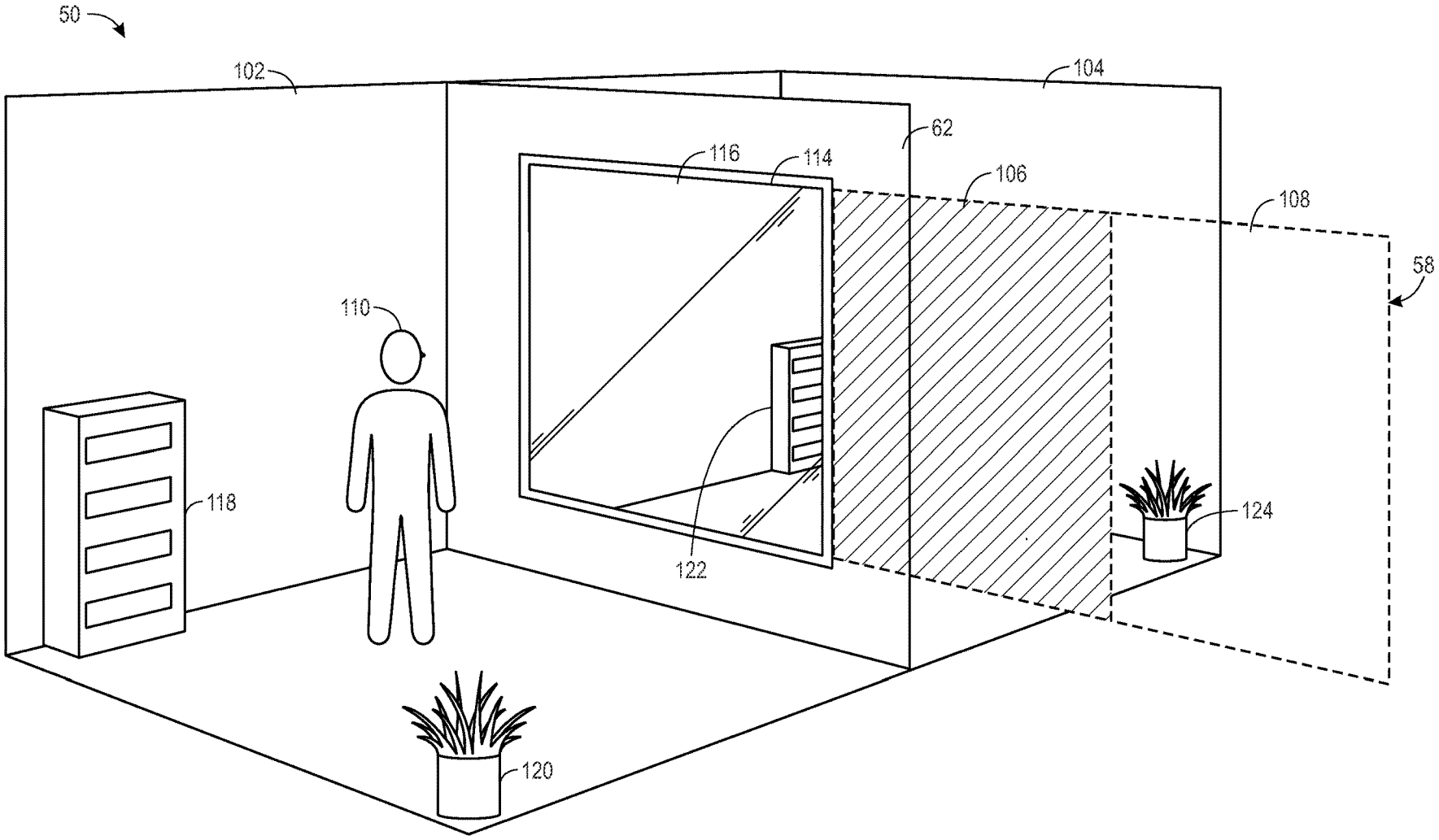
FIG. 3 is a schematic diagram of the illusion system of FIG. 1 generating the vanishing special effect with a transparent portion of the transition glass, in accordance with an embodiment of the present disclosure.

When the transparent portion 116 is in alignment relative to the frame 114, it may appear as if the guest 110 has vanished or become invisible. In other words, the transparent portion 116 may fill the frame 114 while the fading portion 106 and the mirrored portion 108 may not be in the frame 114. As such, FIG. 3 depicts a schematic diagram of the illusion system 50 generating the vanishing special effect with the transparent portion 116 of the transition glass 58, in accordance with an embodiment of the present disclosure. The controller 52 may instruct the actuator 60 to move the transition glass 58 such that the transparent portion 116 may be in alignment relative to the frame 114. The fading or gradual transition from the mirrored portion 108 to the transparent portion 116 may take less than 120 seconds, such as 1 second, 5 seconds, 10 seconds, 30 seconds, 1 minute, or any other suitable time period. The transparent portion 116 may include a rectangular glass, a collection of glass strips of suitable size and shape, and so forth. When the transparent portion 116 is in alignment with the frame 114, the guest 110 may see the second room 104 through the transparent portion 116 of the transition glass 58. Because the second room 104 behind the wall 114 mirrors the first room 102, it may appear as though the first room 102 is empty and the guest 110 has vanished. Movement of the transition glass 58 from the mirrored portion 108 to the transparent portion 116 causes the vanishing special effect.

In additional or alternative embodiments, the illusion system 50 may generate a reappearing special effect (e.g., causing the guest 110 to reappear). By way of example, when the guest 110 enters the first room 102, the transparent portion 116 of the transition glass 58 may be in alignment relative to the frame 114 such that the guest 110 appears to be absent from the first room 102. That is, because the second room 104 behind the wall mirrors the first room 102, it may be appear that the first room 102 is empty, and the guest 110 is not present. In reality, the guest 110 is viewing the second room 104, which completely or partially corresponds to the first room, via the transparent portion 116 of the transition glass 58. When the mirrored portion 108 of the transition glass 58 is in alignment relative to the frame 114, the guest 110 may see a mirrored image of the first room 102, or in other words, a reflection 112 of him or herself and the first room 102. From the perspective of the guest 110, it may seem as if the guest 110 has reappeared. In some embodiments, during the process of moving the transparent portion 116 out of alignment relative to the frame 114, the fading portion 106 may at least partially fill the frame 114 during the transition to displaying the mirrored portion 108.

Figure 4:
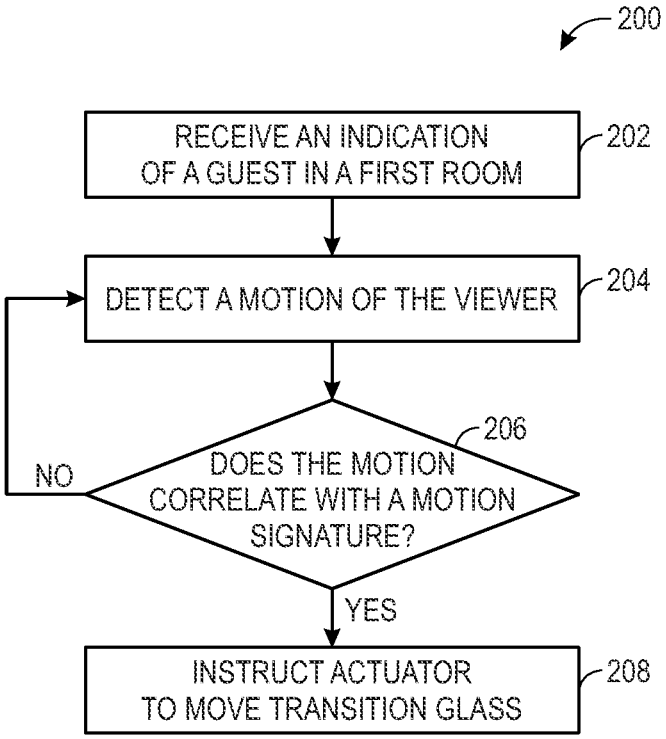
FIG. 4 is a flowchart of a method for generating a vanishing illusion via the transition glass of FIG. 1, in accordance with an embodiment of the present disclosure.

Turning to FIG. 4, a flowchart of a process 200 that generates the vanishing special effect via the transition glass 58 is provided, in accordance with an embodiment of the present disclosure. The process 200 may be performed by any suitable system that may receive sensor data from the one or more sensors 64 and instruct the actuator 60 to move the transition glass 58, such as any component of the illusion system 50, including the controller 52 and/or the processor 54. While the process 200 is described using steps in a specific sequence, it should be understood that the present disclosure contemplates that the described steps may be performed in different sequences than the sequence illustrated, and certain described steps may be skipped or not performed altogether. In some embodiments, the process 200 may be implemented by executing instructions stored in a tangible, non-transitory, computer-readable medium, such as the memory device 56, using a processor, such as the processor 54.

As indicated above, the transition glass 58 may be actuatable, such that its linear movements may be regulated by the actuator 60 based on instructions from the controller 52. At block 202, after the guest 110 has entered the first room 102, the controller 52 receives data indicative of the presence of the guest 110 from the one or more sensors 64. As mentioned above, non-limiting examples of the data that may be indicative of the presence of the guest 110 include motion data, image data, sound data, pressure data and displacement data. In some instances, the one or more sensors 64 include a camera, which acquires image data of the first room 102. In additional or alternative embodiments, the one or more sensors 64 may include a motion sensor that captures movement associated with the guest 110 in the first room. Furthermore, the one or more sensors 64 may include a proximity sensor or an ultrasonic sensor that may measure the distance of the guest 110 relative to the transition glass 58. The one or more sensors may include a sound sensor that captures noise associated with the guest 110. The one or more sensors may also include a piezoelectric sensor that captures pressure associated with the guest 110.

At block 204, the controller 52 detects motion or receives an indication of movement associated with the guest 110. In some embodiments, the detected motion may be provided by the indication received in block 202. That is, the detected motion may be acquired by analyzing the data received from the one or more sensors 64. With respect to the process 200, certain motion data (e.g., a motion signature) may prompt the controller 52 to move the transition glass 58. For instance, if the controller 52 determines motion associated with the guest 110 (e.g., the guest 110 waving a wand in a certain pattern, such as a "FIG. 8" pattern or a zigzag pattern) correlates with a certain predefined motion signature (block 206), then the controller 52 instructs the actuator 60 to move the transition glass 58 (block 208). In some embodiments, the predefined motion signature (or multiple predefined motion signatures) may be stored in a memory or storage device, such as the memory device 56. However, if the controller 52 does not detect the motion signature, then the controller 52 may repeat the process 200 to detect another motion from the guest 110 in the first room 102. In response to detecting the motion signature, the controller 52 may cause the transition glass to move such that the fading portion 106 or the transparent portion 116 is in alignment relative to the wall 114. This movement creates a vanishing effect, in which the guest appears to disappear. In reality, the guest 110 sees the second room 104 through the transparent portion 116 or a part of the second room 104 through the fading portion 106.

In alternative embodiments, the controller 52 may move the transition glass 58 based on acquiring data associated with whether the guest 110 is facing the transition glass 58 and/or whether the guest 110 is within a threshold distance from the transition glass 58 (e.g., without evaluating whether a motion of the guest 110 correlates with a motion signature, thus skipping at least block 206 of the process 200). As mentioned above, such data may be acquired from the one or more sensors 64, which may include a camera and a proximity sensor. Image data of the first room 102 may be acquired via the camera to determine whether the guest 110 is facing the transition glass 58. Data associated with distance away from the transition glass 58 may be acquired via the proximity sensor to determine whether the guest 110 is within a threshold distance from the transition glass 58.

Figure 5:
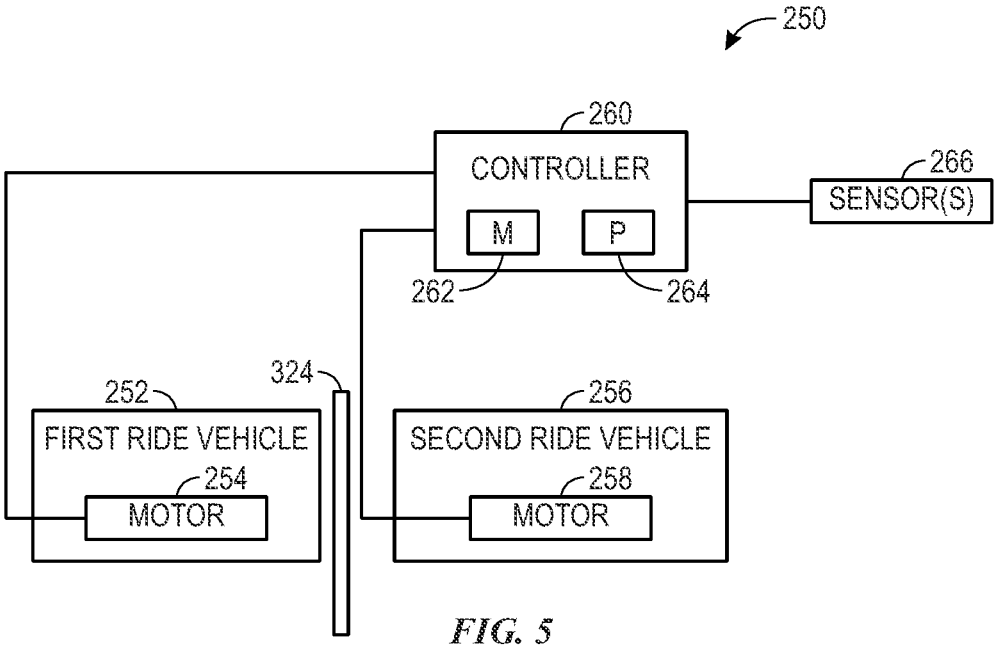
FIG. 5 is a block diagram of an illusion system that generates a vanishing special effect associated with one or more ride vehicles via a transition glass, in accordance with an embodiment of the present disclosure.

In a further embodiment, the vanishing special effect may be achieved via movement of a first ride vehicle 252 and a second ride vehicle 256 relative to a transition glass. FIG. 5 is a block diagram of an illusion system 250 that generates a vanishing special effect via the transition glass (e.g., a stationary transition glass), in accordance with an embodiment of the present disclosure. As shown, the illusion system 250 may include a first ride vehicle 252, a second ride vehicle 256, a controller 260, and one or more sensors 266. In some embodiments, the one or more sensors 266 may be disposed about the first ride vehicle and/or its respective track. The second ride vehicle 256 may mirror the first ride vehicle 252, such that both ride vehicles may match or correlate with one another in size, shape, dimension, color, appearance, and so forth. The first ride vehicle 252 may be separated from the second ride vehicle via the transition glass 324. The transition glass serves as a physical divider between the two ride vehicles. The one or more guests may be seated in the first ride vehicle 252 and may be unaware of the presence of the second ride vehicle behind the transition glass. Further, the transition glass may include a mirrored portion, a fading portion, and a transparent portion.

In certain embodiments, the first and second ride vehicles 252, 256 may move together with one another (e.g., simultaneously) relative to the transition glass 324. Movement of the first and second ride vehicles 252, 256 may be controlled by their respective motors (motor 254 and motor 258). The motors 254 and 258 may be any suitable type of motors for providing motion, including, but not limited to, electrical and/or mechanical motors. Based on instructions from the controller 260, the motors 254 and 258 may regulate the movement of the first and second ride vehicles 252, 256, respectively. In some embodiments, each motor 254 and 258 represents a set of multiple motors that connect to and drive its respective ride vehicle (e.g., along tracks, rails, preplanned routes).

In certain embodiments, the motors 254 and 258 and the one or more sensors 266 are communicatively coupled to the controller 260. The controller 260 may operate similar to and have the same components as the controller 52 of FIG. 1, though the controller 260 may specifically receive data from the one or more sensors 266 and control the motors 254 and 258, which in turn control the movement of the first and second ride vehicles 252, 256. For example, the controller 260 may include a processor(s) 264 and a memory device 262, which may operate similarly to the processor 54 and the memory device 56 of FIG. 1, respectively. In particular, the memory device 56 may store instructions that cause the processor 54 to control the movement of the first and second ride vehicles 252, 256.

In certain embodiments, the first and second ride vehicles 252, 256 may be operated automatically based on determining the presence of the one or more guests seated in the first ride vehicle 252 by the controller 260. Indication of the presence of the one or more guests in the first ride vehicle 252 may be determined based on data acquired from the one or more sensors 266. The one or more sensors 266 may be any of various sensor types useful in providing various operational data to the controller 260. For example, the one or more sensors 266 may detect changes in mass, motion, light, sound and so forth in the first ride vehicle 252. Such data acquired by the one or more sensors may be indicative of the presence of the one or more guests in the first ride vehicle 252. The one or more sensors 266 may include any number or type of sensors, including location sensor, motion sensor, proximity sensor, ultrasonic sensor, photoelectric sensor, micro-electromechanical system (MEMS) sensor, sound sensor, and/or a camera. Additionally, the one or more sensors 266 may include pressure sensors such as piezoelectric pressure sensors, differential pressure sensors, optical pressure sensors, and so on, included on the first ride vehicle 252 and/or its respective track.

Figure 6:
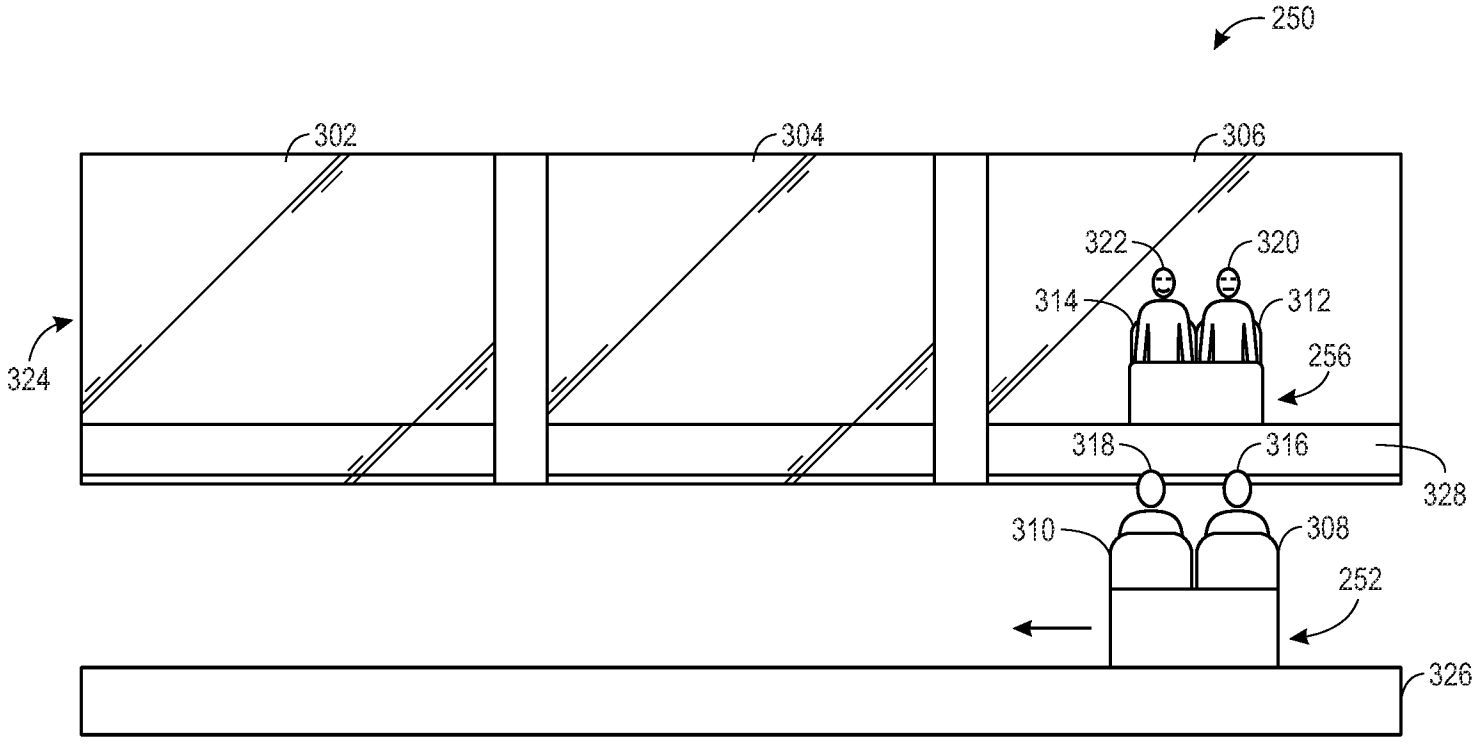
FIG. 6 is a schematic diagram of the illusion system of FIG. 5 generating the vanishing special effect with a mirrored portion of the transition glass, in accordance with an embodiment of the present disclosure.

Based on the data acquired from the one or more sensors 266, the controller 260 determines when and/or how to move the first and second ride vehicles 252, 256. Movement of the first and second ride vehicles 252, 256 along the transition glass 324 may enable the vanishing special effect, in which the one or more guests appear to disappear or turn invisible. With the preceding in mind, FIG. 6 illustrates a schematic of the illusion system 250 of FIG. 5 generating the vanishing special effect with a mirrored portion 306 of the transition glass 324, in accordance with an embodiment of the present disclosure. The system 250 may include the first and second ride vehicles 252, 256. As mentioned previously, the second ride vehicle 256 mirrors the first ride vehicle 252, or in other words, the shape, size and so forth associated with the first ride vehicle 252 correlates with that of the second ride vehicle 256.

The first ride vehicle 252 may move along a track 326 while the second ride vehicle 256 may move along a track 328. The tracks 326 and 328 may correspond or align with each other such that the movement of the second ride vehicle 256 mirrors the movement of the first ride vehicle 252. In some embodiments, the tracks 326 and 328 may be rails, and the first and second ride vehicle 252, 256 may be suspended by their respective rails. In additional or alternative embodiments, the second ride vehicle 256 and its track 328 may be aligned with the first ride vehicle 252 and its track 326 along a line normal to the transition glass 324. In other embodiments, the second ride vehicle 256 and its track 328 may be spaced the same distance away from the transition glass 324 as the first ride vehicle 252 and its track 326 spaced away from the transition glass 324. In some embodiments, there may be no tracks. Instead, the controller 260 may control the pathing of the second ride vehicle 256 to mirror or correlate with the pathing of the first ride vehicle 252.

Guests 316 and 318 may be seated in their respective seats (seat 308 and seat 310) in the first ride vehicle 252. In some embodiments, the first and second ride vehicles 252, 256 may each carry a single guest. Because the first ride vehicle 252 may be separated from the second ride vehicle 256 via the transition glass 324, the second ride vehicle 256 may not be visible to the guests 316 and 318 disposed in the first ride vehicle 252. In fact, the guests 316 and 318 may be unaware of the presence of the second ride vehicle 256. The transition glass 324 may include a mirrored portion 306, a fading portion 304, and a transparent portion 302. Each portion of the transition glass 324 (the mirrored portion 306, the fading portion 304, and the transparent portion 302) may vary or may be similar in dimension with respect to each other. In some embodiments, the first and second ride vehicles 252, 256 may move linearly relative to the transition glass 342 via their respective motors 254 and 258. In additional or alternative embodiments, the first and second ride vehicles 252, 256 may move along curved, zigzag, and so forth paths via their respective tracks 326 and 328, as long as both the first and second ride vehicles 252, 256 mirror each other.

When the guests 316 and 318 enter the first ride vehicle 252 and are seated, the first and second ride vehicles 252, 256 may be in alignment relative to the mirrored portion 306. In other words, the first and second ride vehicles 252, 256 may be facing the mirrored portion 306, but may not be facing the fading portion 304 or the transparent portion 302. The mirrored portion 306 may include a single rectangular mirror, a collection of mirrored strips of suitable size and shape, and so forth. When the first and second ride vehicles 252, 256 are in alignment relative to the mirrored portion 306, the guests 316 and 318 may see a mirrored image of the first ride vehicle. In other words, the guests 316 and 318 may see their respective reflections (320 and 322) and respective seat reflections (312 and 314).

Once the guests 316 and 318 are seated in the first ride vehicle 252, the controller 260 may receive data indicative of the presence of the guests 316 and 318 from the one or more sensors 266. Non-limiting examples of the data, which may be indicative of the presence of the guests 316 and 318 and/or may prompt the controller 260 to move the first and second ride vehicles 252, 256 in conjunction with one another (e.g., simultaneously) relative to the transition glass 324, may include motion data, image data, sound data, pressure data, and displacement data. In some embodiments, the controller 260 may not receive data indicative of the presence of the guests 316 and 318 from the one or more sensors 266. Instead, both ride vehicles 252, 256 may move in continuous loops along their respective tracks 326 and 328. As another example, the first ride vehicle 252 may be stopped and/or started by a theme park employee, and the controller 260 may correlate movement of the second ride vehicle 256 with the first ride vehicle 252.

Figure 7:
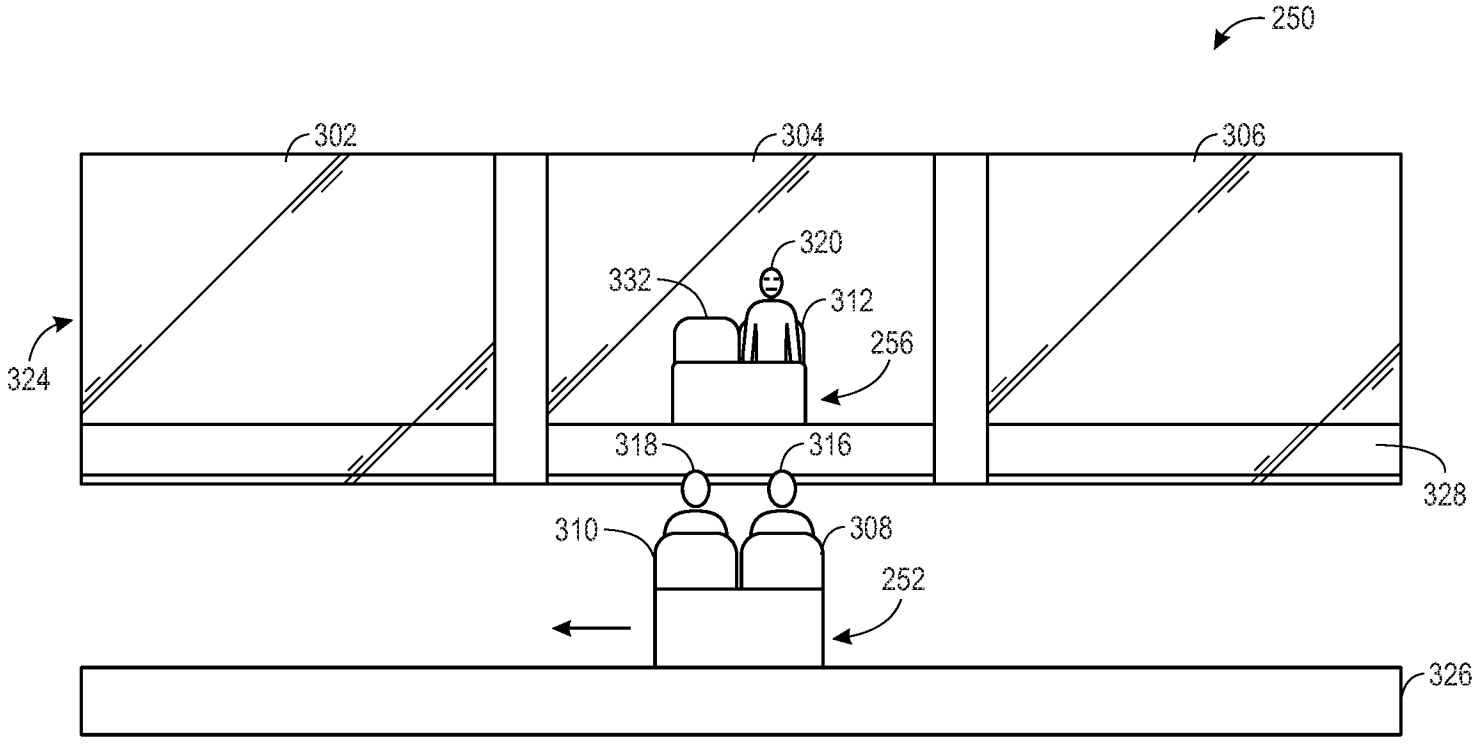
FIG. 7 is a schematic diagram of the illusion system of FIG. 5 generating the vanishing special effect with a fading portion of the transition glass, in accordance with an embodiment of the present disclosure.

After the controller 260 instructs the motors 254 and 258 to respectively move the first and second ride vehicles 252, 256, the first and second ride vehicles 252, 256 may move together to be out of alignment relative to the mirrored portion 306, and into alignment relative to the fading portion 304. With the preceding in mind, FIG. 7 is a schematic of the illusion system 250 of FIG. 5 generating the vanishing special effect with a fading portion 304 of the transition glass 324, in accordance with an embodiment of the present disclosure. The fading portion 304 includes a combination of a mirrored part and a transparent part. In certain embodiments, the fading portion 304 may consist of a combination of thin strips of mirror and thick strips of glass. The strips may be triangular, rectangular, or any other suitable shape. In alternative or additional embodiments, the fading portion 304 may include other suitable forms or materials (e.g., frosted glass) to cause an effect indicating that the vanishing effect is occurring. As a result, the guests 316 and 318 may see a combination of a portion of the mirrored image of the first ride vehicle 252 and a portion of the second ride vehicle 256 via the transition glass 324. The fading portion 304 serves as a transition from a reflection of the guests 316 and 318 in the first ride vehicle 252 to a vanishing appearance of the guests 316 and 318 in the first ride vehicle 252.

Because the guests 316 and 318 may be unaware of the presence of the second 256 ride vehicle, the vanishing special effect or illusion may be effective. When the first and second ride vehicles 252, 256 are in alignment relative to the fading portion 304, the first and second ride vehicles 252, 256 are not facing the mirrored portion 306 or the transparent portion 302. From the perspective of the guests 316 and 318, when the first and second ride vehicles 252, 256 are in alignment relative to the fading portion 304, it may appear as if they may be starting to disappear from the first ride vehicle 252. In reality, through the mirrored part of the fading portion 304, the guests 316 and 318 may see a portion of their reflections in the first ride vehicle 252. Further, through the transparent part of the fading portion 304, the guests 316 and 318 may see a portion of the second ride vehicle 256, which appears to be empty. For example, if the seat 308 of the first ride vehicle 252 is in alignment with the mirrored part of the fading portion 304, then the guest 316 may see a reflection 320 of himself or herself and a reflection 312 of seat 308. Meanwhile, if the seat 310 of the first ride vehicle 252 is in alignment with the transparent part of the fading portion 304, then the guest 318 may appear to have vanished. The guest 318 may appear to see seat 310 as empty, but in reality the guest 318 may see a seat 332 of the second ride vehicle 256 via the transparent part of the fading portion 304. In alternative embodiments, the transition glass 324 may not include the fading portion 106. Thus, a fading or gradual transition between the mirrored portion 306 and the transparent portion 302 may not exist. Further, the fading or gradual transition from viewing a reflection of the first ride vehicle 252 and the guests 316 and 318 to viewing of the second ride vehicle 256 and a vanishing appearance of the guests 316 and 318 may not be present.

Figure 8:
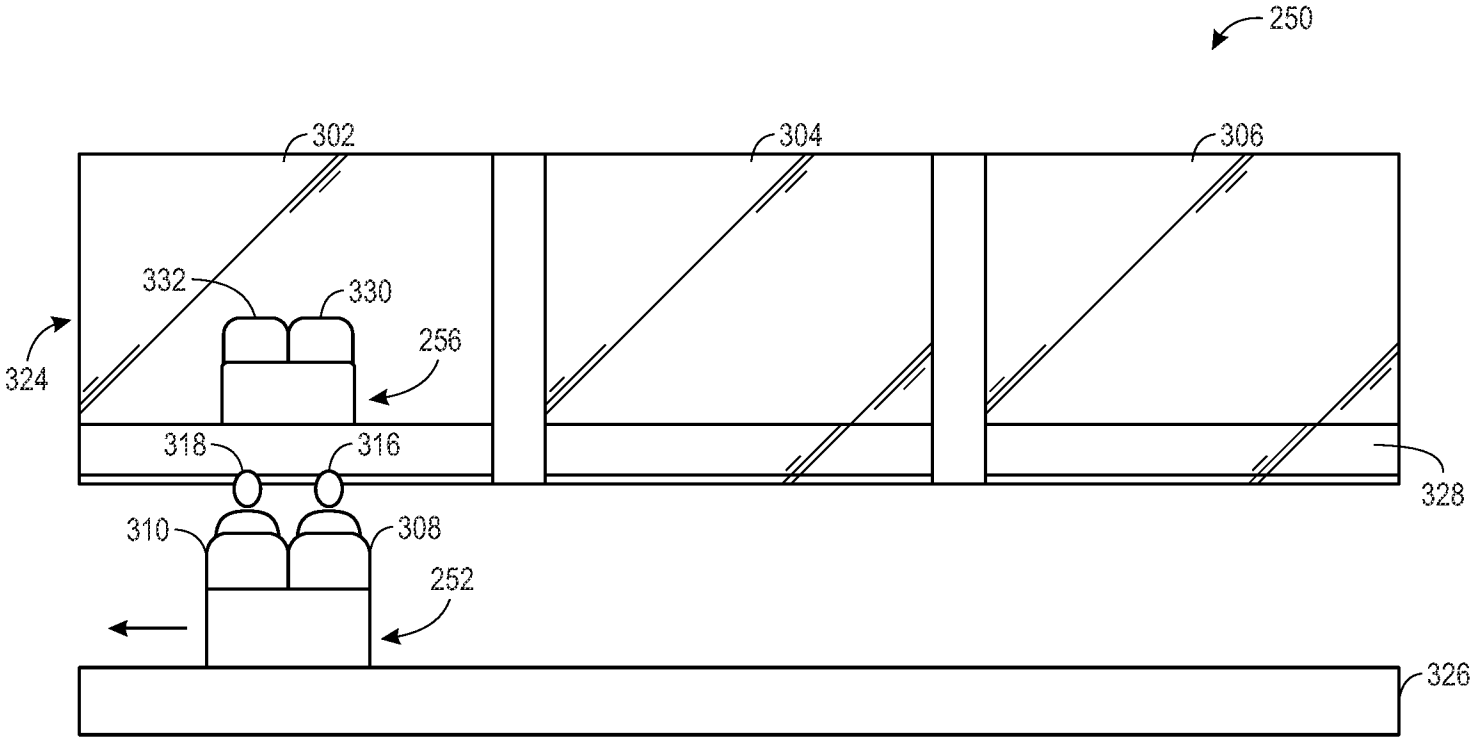
FIG. 8 is a schematic diagram of the illusion system of FIG. 5 generating the vanishing special effect with a transparent portion of the transition glass, in accordance with an embodiment of the present disclosure.

When the first and second ride vehicles 252, 256 are in alignment relative to the transparent portion 302, it may appear as if the guests 316 and 318 have vanished or become invisible. FIG. 8 depicts a schematic of the illusion system 250 of FIG. 5 generating the vanishing special effect with the transparent portion 302 of the transition glass 324, in accordance with an embodiment of the present disclosure. The controller 260 may instruct the motors 254 and 258 to move the first and second ride vehicles 252, 256 into alignment relative to the transparent portion 302. In other words, the first and second ride vehicles 252, 256 may be facing the transparent portion 302, but may not be facing the mirrored portion 306 or the fading portion 304. The fading or gradual transition from the first and second ride vehicles 252, 256 being in alignment with the mirrored portion 306 to the transparent portion 302 may take less than a second, or may take 1-120 seconds, such as 5 seconds, 10 seconds, 30 seconds, 1 minute, or any other suitable time period. The transparent portion 302 may include a single rectangular glass, a collection of glass strips of suitable size and shape, and so forth. When the first and second ride vehicles 252, 256 are in alignment relative to the transparent portion 302, the guests 316 and 318 may see the second ride vehicle 256. Because the second ride vehicle 256 behind the transition glass 324 travels along with or mirrors the first ride vehicle 252, it may be appear as though the first ride vehicle 252 is empty, and that the guests 316 and 318 may have vanished. In reality, the guests 316 and 318 may see the second ride vehicle 256 and its seats 330 and 332 through the transparent portion 302 of the transition glass 324. Movement of the first 252 and second 256 ride vehicles from the mirrored portion 306 to the transparent portion 302 causes the vanishing special effect.

While only certain features of the disclosure have been illustrated and described herein, many modifications and changes will occur to those skilled in the art. It is, therefore, to be understood that the appended claims are intended to cover all such modifications and changes as fall within the true spirit of the present disclosure. The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system for generating a vanishing illusion, the system comprising:

a first room;

a second room, wherein the second room mirrors the first room;

a wall separating the first room from the second room, wherein the wall comprises:

a transition glass comprising a mirrored portion and a transparent portion; and a frame through which the transition glass is configured to move; and an actuator configured to move the transition glass with respect to the frame such that the mirrored portion is in alignment or out of alignment relative to the frame based on a trigger or a condition being met.

2. The system of claim 1, comprising a controller communicatively coupled to the actuator and one or more sensors, wherein the controller is configured to instruct the actuator to move the transition glass in response to receiving data associated with motion, light, sound, and any combination thereof from the one or more sensors.

3. The system of claim 2, wherein the one or more sensors are configured to detect motion in the first room.

4. The system of claim 1, wherein the transition glass comprises a fading portion disposed between the transparent portion and the mirrored portion.

5. The system of claim 4, wherein the fading portion enables simultaneously viewing of a mirrored portion of the first room and a portion of the second room during operation.

6. The system of claim 4, wherein the fading portion comprises one or more alternating strips of mirror and one or more alternating strips of glass.

7. The system of claim 4, wherein movement of the fading portion enables a gradual transition between the mirrored portion and the transparent portion during operation, wherein the fading portion comprises more mirrored parts and less transparent parts closer to the mirrored portion, and wherein the fading portion comprise less mirrored parts and more transparent parts closer to the transparent portion.

8. The system of claim 1, wherein, when the mirrored portion is in alignment relative to the frame during operation, the transition glass enables viewing of a mirrored image of the first room to a viewer in the first room.

9. The system of claim 1, wherein, when the transparent portion is in alignment relative to the frame during operation, the transition glass enables viewing of the second room to a viewer in the first room.

10. A method for generating a vanishing illusion, the method comprising:

receiving, via a processor, an indication of a viewer disposed in a first room based at least in part on data acquired from one or more sensors, wherein the first room mirrors a second room, and is separated from the second room via a wall, wherein the wall comprises a frame through which the transition glass is configured to move, and wherein the transition glass comprises a mirrored portion and a transparent portion;

receiving, via the processor, an indication of movement in the first room via the one or more sensors; and actuating, via the processor, the transition glass to move with respect to the frame such that the mirrored portion is out of alignment relative to the frame in response to identifying the motion signature.

11. The method of claim 10, wherein the transition glass comprises a fading portion disposed between the transparent portion and the mirrored portion.

12. The method of claim 11, wherein the fading portion comprises a plurality of mirror pieces and a plurality of glass pieces.

13. The method of claim 10, wherein the processor actuates the transition glass based on determining that the viewer is within a threshold distance from the transition glass.

14. The method of claim 10, wherein the indication of the movement correlates with a predefined motion signature.

15. A theme park attraction system for generating a vanishing illusion, the theme park attraction system comprising:

a first ride vehicle;

a second ride vehicle, wherein the second ride vehicle mirrors the first ride vehicle;

a transition glass that separates the first ride vehicle from the second ride vehicle over at least a portion of a ride path, wherein the transition glass comprises a mirrored portion and a transparent portion; and one or more motors configured to move the first ride vehicle and the second ride vehicle from a first position in alignment relative to the mirrored portion to a second position in alignment relative to the transparent portion.

16. The theme park attraction system of claim 15, comprising a controller communicatively coupled to the one or more motors, wherein the controller is configured to instruct the one or more motors to move the first ride vehicle and the second ride vehicle.

17. The theme park attraction system of claim 15, wherein the second ride vehicle moves in the same direction as the first ride vehicle along the transition glass, and wherein the second ride vehicle maintains the same distance from the transition glass as the first ride vehicle.

18. The theme park attraction system of claim 15, wherein, when the first and second ride vehicles are in alignment relative to the mirrored portion, the transition glass enables viewing of a mirrored image of the first ride vehicle.

19. The theme park attraction system of claim 15, wherein, when the first and second ride vehicle are in alignment relative to the transparent portion, the transition glass enables viewing of the second ride vehicle.

20. The theme park attraction system of claim 15, wherein, when the first and second ride vehicle are in alignment relative to the fading portion, the transition glass enables viewing of a portion of a mirrored image of the first ride vehicle and a portion of the second ride vehicle.

* * * * *